US009601870B1

(12) United States Patent
Ebisawa

(10) Patent No.: US 9,601,870 B1
(45) Date of Patent: Mar. 21, 2017

(54) LOCKING STRUCTURE OF CONNECTOR ASSEMBLY

(71) Applicant: Japan Aviation Electronics Industry, Limited, Tokyo (JP)

(72) Inventor: Takeshi Ebisawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/207,758

(22) Filed: Jul. 12, 2016

(30) Foreign Application Priority Data

Nov. 4, 2015 (JP) ..... 2015-216902

(51) Int. Cl.

| | |
|---|---|
| ***H01R 9/05*** | (2006.01) |
| ***H01R 13/635*** | (2006.01) |
| ***H01R 24/38*** | (2011.01) |
| *H01R 103/00* | (2006.01) |

(52) U.S. Cl.
CPC ..... *H01R 13/635* (2013.01); *H01R 24/38* (2013.01); *H01R 2103/00* (2013.01)

(58) Field of Classification Search
CPC ... H01R 13/635; H01R 24/38; H01R 2103/00
USPC ..... 439/320, 321, 578
See application file for complete search history.

(56) References Cited

U.S. PATENT DOCUMENTS 8,579,659 B2 * 11/2013 Tran ..... H01R 13/625 439/578
8,618,944 B2 * 12/2013 Montena ..... H01R 13/641 340/635
8,636,541 B2 * 1/2014 Chastain ..... H01R 9/05 439/578
8,827,743 B1 * 9/2014 Maury ..... H01R 24/40 439/578
8,864,519 B2 * 10/2014 Wei ..... H01R 9/05 439/578

OTHER PUBLICATIONS

IEC61169-5 ed 1.0, "RF and Microwave passive components", International Electro technical Commission, Jul. 4, 2014, pp. 1-33.

* cited by examiner

*Primary Examiner* — Khiem Nguyen
(74) *Attorney, Agent, or Firm* — Muncy, Geissler, Olds & Lowe, P.C.

(57) ABSTRACT

A locking structure of a connector assembly has a plug and a receptacle, the plug including a plug shell, a sleeve disposed on outer periphery of the plug shell, and a C-ring disposed between the plug shell and the sleeve, the receptacle including a receptacle shell having an end that is inserted between the plug shell and the sleeve when the receptacle is fitted to the plug, the C-ring having an inclined sleeve contacting surface on its outer periphery and an inclined receptacle shell contacting surface on its inner periphery, the C-ring being elastically deformable between a first state and a second state, a fitted state between the plug and the receptacle being locked when, with the C-ring being in the first state, the sleeve contacting surface comes in contact with the sleeve and the receptacle shell contacting surface comes in contact with the receptacle shell.

8 Claims, 6 Drawing Sheets

LOCKING STRUCTURE OF CONNECTOR ASSEMBLY

BACKGROUND OF THE INVENTION

The present invention relates to locking structures of connector assemblies, particularly to a locking structure of a connector assembly having a plug and a receptacle that are fitted to each other along a fitting direction.

A connector assembly having a locking structure is illustrated in IEC61169-54 ed 1.0, RF and Microwave passive components, p 14, FIG. 5 Quick lock type (Literature 1). As shown in FIG. 15, the connector assembly has a plug 1 and a receptacle 2. When the plug 1 is slid with respect to the receptacle 2 in the +X direction which is the fitting direction, a plug shell 3 of the plug 1 is fitted into a receptacle shell 4 of the receptacle 2, thereby establishing the fitted state between the plug 1 and the receptacle 2.

A sleeve 5 is disposed on the outer periphery of the plug shell 3. In the fitted state between the plug 1 and the receptacle 2, a part of a C-ring 6 housed in a C-ring housing groove 5A formed in the inner periphery of the sleeve 5 is inserted in a locking groove 4A formed in the outer periphery of the receptacle shell 4.

The C-ring housing groove 5A formed in the inner periphery of the sleeve 5 has a vertical surface 5B being perpendicular to the fitting direction and facing in the −X direction, the locking groove 4A of the receptacle shell 4 has a vertical surface 4B being perpendicular to the fitting direction and facing in the +X direction, and the +X direction-side and −X direction-side ends of the C-ring 6 form vertical surfaces 6A and 6B being perpendicular to the fitting direction and facing in the +X and −X directions, respectively.

By bringing the vertical surface 6A of the C-ring 6 at its +X direction-side end into contact with the vertical surface 5B of the sleeve 5 and the vertical surface 6B of the C-ring 6 at its −X direction-side end into contact with the vertical surface 4B of the receptacle shell 4, the fitted state between the plug 1 and the receptacle 2 is locked. In other words, even when an external force acts to separate the plug 1 and the receptacle 2 in the fitted state from each other, the configuration above prevents the plug 1 from coming off the receptacle 2.

The distance A between a corner 5C of the vertical surface 5B of the sleeve 5 and a corner 4C of the vertical surface 4B of the receptacle shell 4 in the fitting direction and the distance B therebetween in the radial direction perpendicular to the fitting direction are specified to certain values as the standards, as stated in Literature 1 above.

The plug 1 further includes a coupling 7 disposed on the outer periphery of the sleeve 5 to be slidable in the fitting direction. When the coupling 7 is slid in the −X direction with respect to the plug 1 in the fitted state, this causes a turning-back portion 7A formed on the radially-inward side of the coupling 7 to exert a radially-outward force toward the C-ring 6 so that the ring diameter of the C-ring 6 elastically increases, whereby the vertical surface 6B of the C-ring 6 at its −X direction-side end is separated from the vertical surface 4B of the receptacle shell 4, thus the lock of the fitted state between the plug 1 and the receptacle 2 is released. Accordingly, the plug 1 can be come off the receptacle 2.

Meanwhile, when the plug 1 and the receptacle 2 in the fitted state are being separated from each other, a force F1 directed in the −X direction is exerted from the vertical surface 5B of the sleeve 5 to the vertical surface 6A of the C-ring 6 at its +X direction-side end, and at the same time, a force F2 directed in the +X direction is exerted from the vertical surface 4B of the receptacle shell 4 to the vertical surface 6B of the C-ring 6 at its −X direction-side end. Those forces F1 and F2 are away from each other by about the distance B in the radial direction perpendicular to the fitting direction and accordingly, a couple of forces occurs at the C-ring 6. This couple forms a force FA that acts to deform the +X direction-side end of the C-ring 6 in the radially-outward direction, and when a force acting to separate the plug 1 and the receptacle 2 from each other increases, the C-ring 6 may be plastically deformed beyond the limit of elasticity and get broken.

SUMMARY OF THE INVENTION

The present invention has been made to solve the problem in the related art described above and an object of the present invention is to provide a lock structure of a connector assembly capable of locking the fitted state between a plug and a receptacle even when a strong external force acts to separate the plug and the receptacle from each other.

A locking structure of a connector assembly according to the present invention has a plug and a receptacle that are fitted to each other along a fitting axis, wherein the plug includes a plug shell of cylindrical shape, a sleeve of cylindrical shape disposed on outer periphery of the plug shell, and a C-ring disposed between the outer periphery of the plug shell and inner periphery of the sleeve, wherein the receptacle includes a receptacle shell of cylindrical shape having an end that is inserted between the outer periphery of the plug shell and the inner periphery of the sleeve when the receptacle is fitted to the plug, wherein the C-ring has, on its outer periphery, a sleeve contacting surface facing in a first direction and a radially-outward direction and, on its inner periphery, a receptacle shell contacting surface facing in a second direction and a radially-inward direction, the first direction being a direction from the plug to the receptacle along the fitting axis, and the second direction being a direction opposite from the first direction along the fitting axis, and the C-ring is elastically deformable between a first state in which the C-ring has a ring diameter allowing the receptacle shell contacting surface to come in contact with the receptacle shell and a second state in which the C-ring has a ring diameter, larger than that in the first state, allowing the receptacle shell contacting surface to separate from the receptacle shell, wherein the sleeve contacting surface and the receptacle shell contacting surface each form an inclined surface extending to diagonally intersect the fitting axis, and wherein when, with the C-ring being in the first state, the sleeve contacting surface comes in contact with the sleeve and the receptacle shell contacting surface comes in contact with the receptacle shell, a fitted state between the plug and the receptacle is locked.

DETAILED DESCRIPTION OF THE INVENTION

Embodiments of the present invention are described below based on the appended drawings.

Embodiment 1

Figure 1:
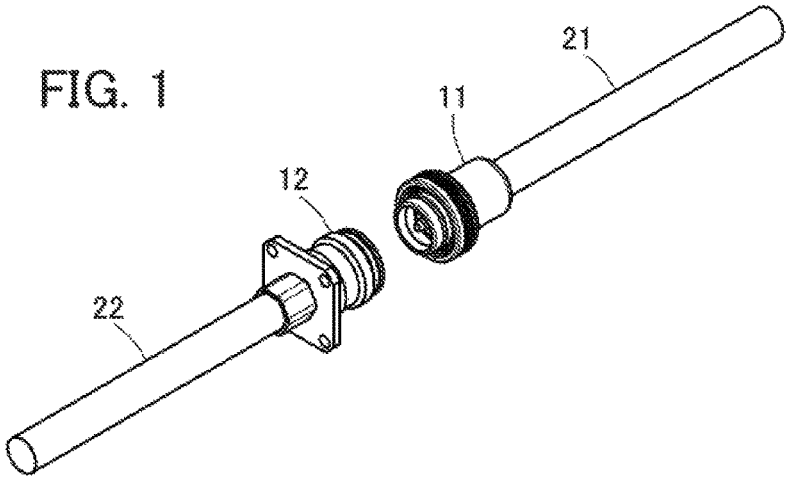
FIG. 1 is a perspective view showing coaxial cables to which components of a connector assembly according to Embodiment 1 of the invention are attached, in a non-fitted state.

As shown in FIG. 1, a connector assembly in Embodiment 1 includes a plug 11 and a receptacle 12. The plug 11 and the receptacle 12 are attached to ends of corresponding coaxial cables 21 and 22, respectively.

Figure 2:
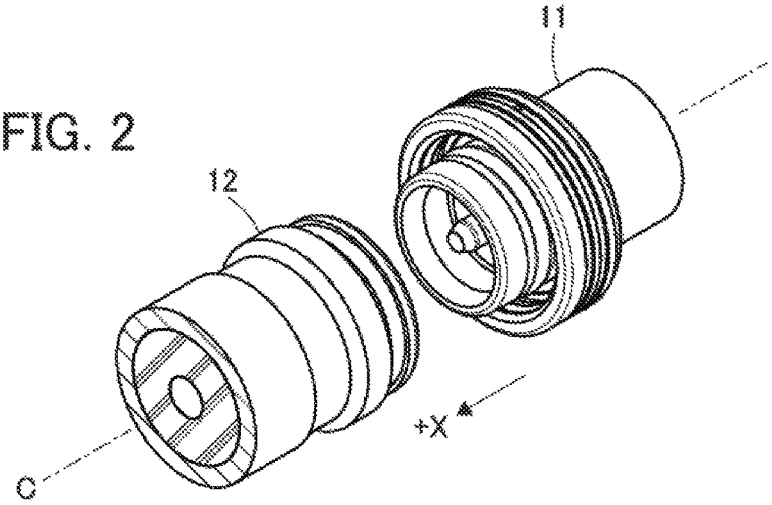
FIG. 2 is a perspective view showing the connector assembly according to Embodiment 1 in the non-fitted state.

The plug 11 and the receptacle 12 are placed to be coaxial to a fitting axis C as shown in FIG. 2. The plug 11 and the receptacle 12 are relatively moved along the fitting axis C to approach each other and fitted to each other. For convenience, the direction from the plug 11 to the receptacle 12 along the fitting axis C is called "+X direction (first direction)" and the direction from the receptacle 12 to the plug 11 "−X direction (second direction)."

Figure 3:
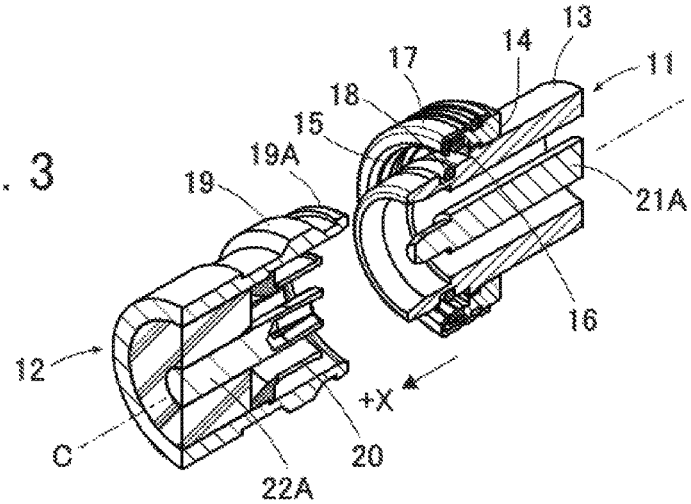
FIG. 3 is a broken perspective view showing the connector assembly according to Embodiment 1 in the non-fitted state.
Figure 4:
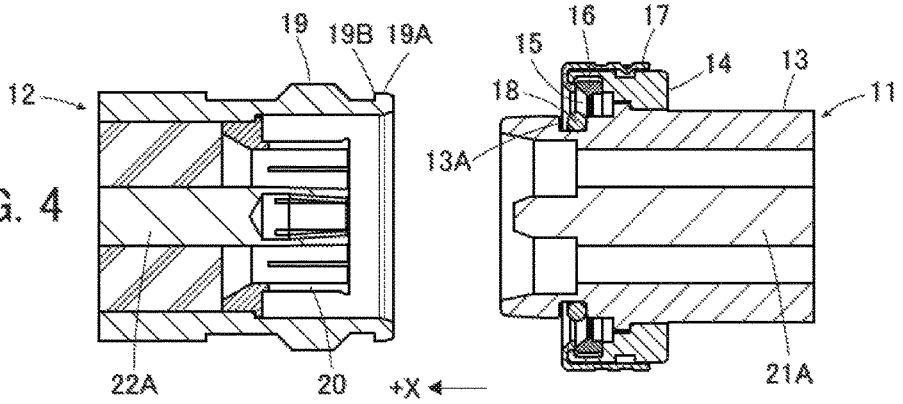
FIG. 4 is a cross-sectional view showing the connector assembly according to Embodiment 1 in the non-fitted state.

As shown in FIGS. 3 and 4, the plug 11 includes a cylindrical plug shell 13 whose central axis coincides with the fitting axis C, and a cylindrical sleeve 14 whose central axis coincides with the fitting axis C and which is disposed on the outer periphery of the plug shell 13. A receptacle shell housing portion 15 of annular shape is formed between a +X direction-side portion of the sleeve 14 and the outer periphery of the plug shell 13. A C-ring 16 is disposed in the receptacle shell housing portion 15. The C-ring 16 is designed to be elastically deformable, and when the C-ring 16 is elastically deformed in the receptacle shell housing portion 15, the ring diameter of the C-ring 16 changes. A cylindrical coupling 17 whose central axis coincides with the fitting axis C is disposed on the outer periphery of the sleeve 14 to be slidable with respect to the sleeve 14 in the X direction along the fitting axis C.

An annular groove 13A is formed in the outer periphery of the plug shell 13 facing the receptacle shell housing portion 15, and an O-ring 18 is fitted in the annular groove 13A.

A central conductor 21A of the coaxial cable 21 to which the plug 11 is attached is disposed in the plug shell 13 to be coaxial with the fitting axis C and has a +X direction-side end of pin shape.

The receptacle 12 includes a cylindrical receptacle shell 19 whose central axis coincides with the fitting axis C, and an external conductor spring member 20 is disposed in the receptacle shell 19 to be in contact with the inner surface of the receptacle shell 19. The external conductor spring member 20 comes in contact with the inner surface of the plug shell 13 of the plug 11 in fitting between the plug 11 and the receptacle 12 to establish the electrical connection between the plug shell 13 and the receptacle shell 19.

When the plug 11 and the receptacle 12 are fitted to each other, a −X direction-side end 19A of the receptacle shell 19 is housed in the receptacle shell housing portion 15 of the plug 11. A receptacle corner 19B is formed at the end 19A of the receptacle shell 19 to face in the +X and radially-outward directions.

A central conductor 22A of the coaxial cable 22 to which the receptacle 12 is attached is disposed in the receptacle shell 19 to be coaxial with the fitting axis C and has a −X direction-side end of socket shape.

Figure 5:
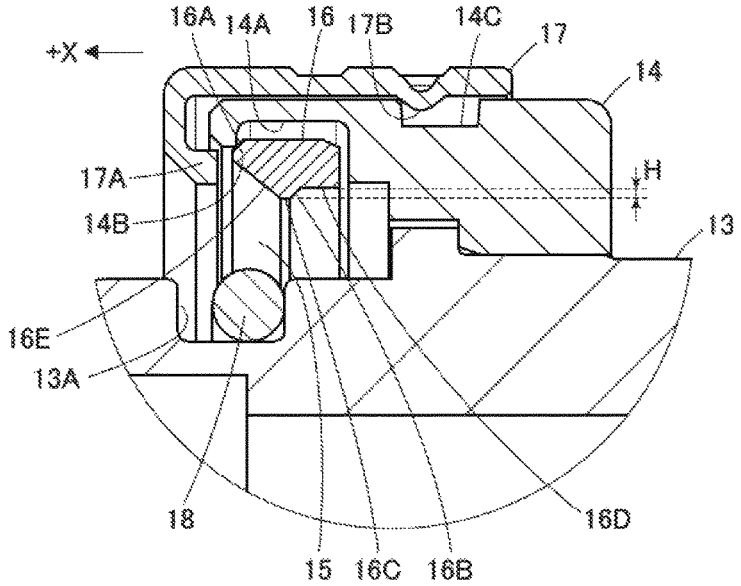
FIG. 5 is a cross-sectional view partially showing the main portion of a plug of the connector assembly according to Embodiment 1.

FIG. 5 shows a cross-sectional structure of a region including and around the sleeve 14, the C-ring 16 and the coupling 17 of the plug 11. A C-ring housing groove 14A facing the receptacle shell housing portion 15 is formed in the inner periphery of the sleeve 14 of the plug 11 at the +X direction side, and a sleeve corner 14B facing in the −X and radially-inward directions is formed at the +X direction-side end of the C-ring housing groove 14A. An annular groove 14C is formed in the outer periphery of the sleeve 14.

The C-ring 16 has a sleeve contacting surface 16A on the outer periphery of the +X direction-side end and a receptacle shell contacting surface 16B at a position away from the sleeve contacting surface 16A in the −X direction, on the inner periphery. The sleeve contacting surface 16A faces in the +X and radially-outward directions, while the receptacle shell contacting surface 16B faces in the −X and radially-inward directions. The sleeve contacting surface 16A and the receptacle shell contacting surface 16B lie parallel to each other and each form an inclined surface extending to diagonally intersect the X direction, namely, the fitting axis C.

The C-ring 16 further has cylindrical surfaces 16C and 16D that are positioned across the receptacle shell contacting surface 16B and adjacent to the receptacle shell contacting surface 16B on the +X direction and −X direction sides, respectively.

The cylindrical surface 16C lies at the innermost position on the C-ring 16. The cylindrical surfaces 16C and 16D are positioned away from each other in the radial direction with a height difference H.

A receptacle shell inviting surface 16E is formed next to the cylindrical surface 16C on the +X direction side and forms an inclined surface facing in the +X and radially-inward directions.

The coupling 17 has, at the +X direction-side end, a turning-back portion 17A that lies on the radially-inward side and extends in the −X direction. The turning-back portion 17A lies radially more inward than the +X direction-side end of the sleeve 14. The turning-back portion 17A is configured to, when the coupling 17 is slid with respect to the sleeve 14 in the −X direction, come in contact with the +X direction-side end of the C-ring 16.

The coupling 17 further has, at a −X direction-side portion, a convex 17B that projects in the radially-inward direction. The convex 17B is placed in the annular groove 14C formed in the outer periphery of the sleeve 14, which allows the coupling 17 to be held by the sleeve 14 to be slidable in the +X and −X directions without coming off the sleeve 14.

Figure 6:
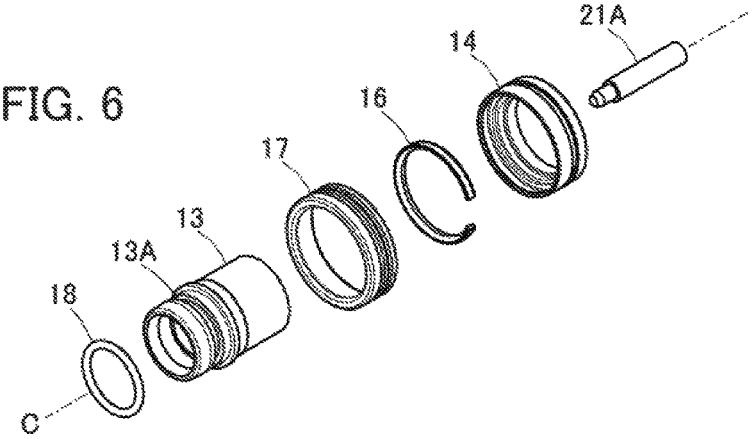
FIG. 6 is an exploded view of the plug of the connector assembly according to Embodiment 1.

The plug 11 having such a configuration is assembled by attaching the sleeve 14 to the plug shell 13, fitting the C-ring 16 and the coupling 17 to the sleeve 14 and fitting the O ring 18 to the annular groove 13A of the plug shell 13, and installed to the coaxial cable by attaching the plug shell 13 to the end of the coaxial cable so that the central conductor 21A is inserted in the plug shell 13, as shown in FIG. 6.

Figure 7:
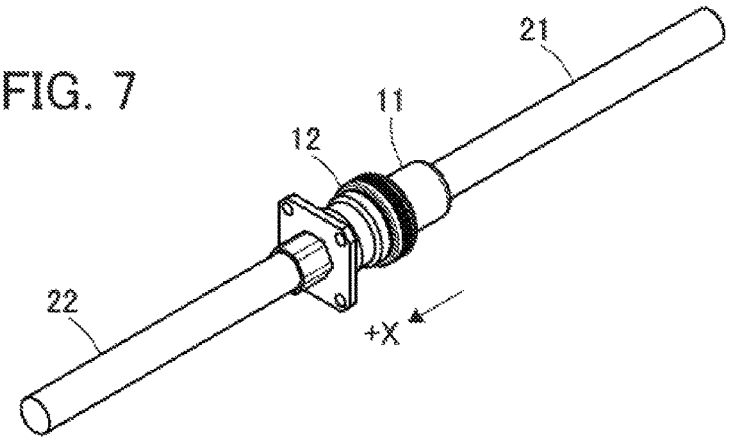
FIG. 7 is a perspective view showing the coaxial cables to which the components of the connector assembly according to Embodiment 1 of the invention are attached, in the fitted state.

As shown in FIG. 7, the plug 11 and the receptacle 12 are relatively moved along the X direction to approach each other and thereby fitted to each other.

Figure 8:
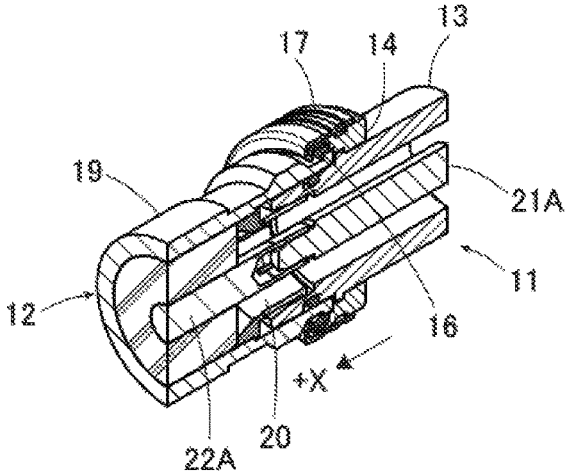
FIG. 8 is a broken perspective view showing the connector assembly according to Embodiment 1 in the fitted state.
Figure 9:
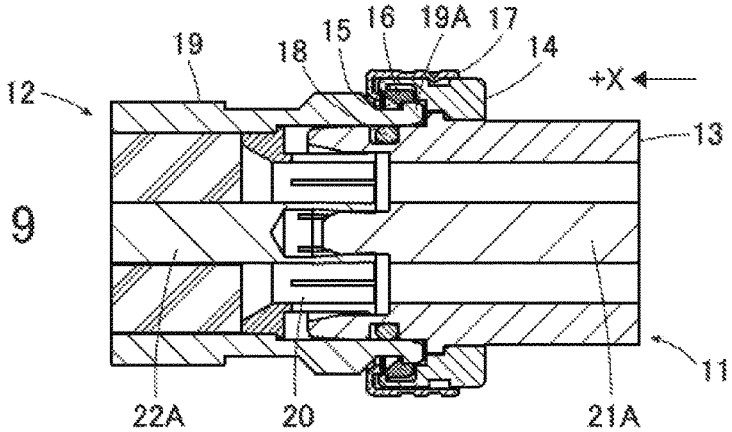
FIG. 9 is a cross-sectional view showing the connector assembly according to Embodiment 1 in the fitted state.

In the fitted state, as shown in FIGS. 8 and 9, the pin-shaped, +X direction-side end of the central conductor 21A in the plug 11 and the socket-shaped, −X direction-side end of the central conductor 22A in the receptacle 12 are fitted to each other to establish the electrical connection, while the external conductor spring member 20 of the receptacle 12 is in contact with the inner surface of the plug shell 13 of the plug 11 to establish the electrical connection between the plug shell 13 and the receptacle shell 19.

Figure 10:
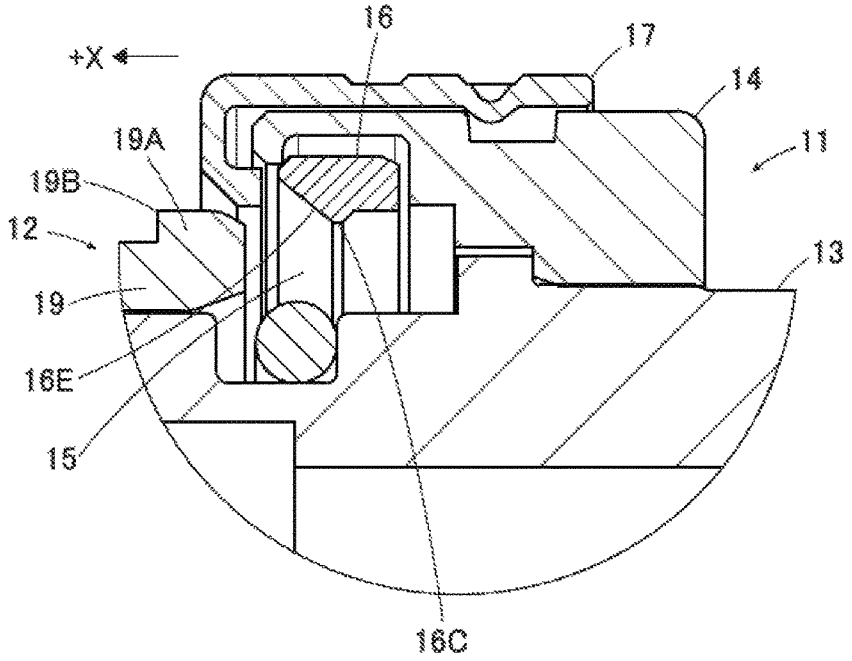
FIG. 10 is a cross-sectional view partially showing a locking structure of the connector assembly according to Embodiment 1 at the start of fitting operation.

In the fitting operation between the plug 11 and the receptacle 12, as shown in FIG. 10, the −X direction-side end 19A of the receptacle shell 19 of the receptacle 12 is relatively moved in the −X direction along the outer periphery of the plug shell 13 of the plug 11 and gradually housed in the receptacle shell housing portion 15 of annular shape between the sleeve 14 and the outer periphery of the plug shell 13.

Then, the end 19A of the receptacle shell 19 comes in contact with the receptacle shell inviting surface 16E, which faces in the +X and radially-inward directions, of the C-ring 16 and is further moved in the −X direction in the receptacle shell housing portion 15 while elastically deforming the C-ring 16 to increase the ring diameter of the C-ring 16.

Figure 11:
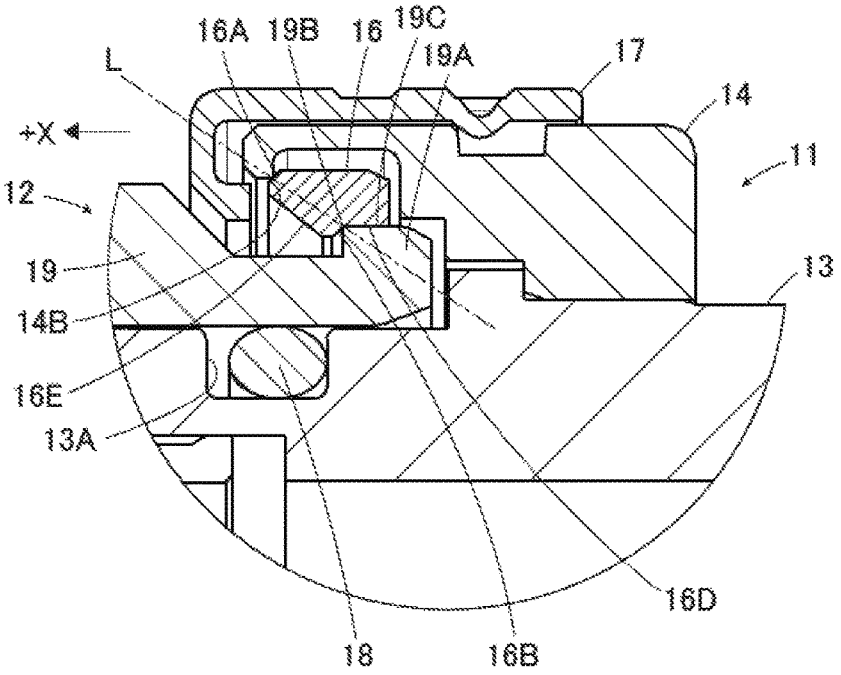
FIG. 11 is a cross-sectional view partially showing the locking structure of the connector assembly according to Embodiment 1 in a fitted state.

When the end 19A of the receptacle shell 19 is inserted to pass over the cylindrical surface 16C and the receptacle shell contacting surface 16B of the C-ring 16 and reaches the cylindrical surface 16D at the −X direction side, the ring diameter of the C-ring 16 decreases so that the cylindrical surface 16D of the C-ring 16 comes in contact with an outer surface 19C of the end 19A of the receptacle shell 19, whereby the fitting between the plug 11 and the receptacle 12 is established, as shown in FIG. 11. The state of the C-ring 16 with a ring diameter at this time is called "first state."

When the plug 11 and the receptacle 12 are fitted to each other, the O ring 18 in the annular groove 13A of the plug shell 13 serves to seal between the plug shell 13 and the receptacle shell 19.

When the plug 11 and the receptacle 12 are fitted to each other and the C-ring 16 is in the first state, as shown in FIG. 11, the sleeve contacting surface 16A of the C-ring 16 lies at the same position in the radial direction as the sleeve corner 14B of the sleeve 14, and since the outer surface 19C of the end 19A of the receptacle shell 19 is in contact with the cylindrical surface 16D of the C-ring 16, the receptacle shell contacting surface 16B of the C-ring 16 lies at the same position in the radial direction as the receptacle corner 19B of the receptacle shell 19.

Accordingly, when an external force acts to separate the plug 11 and the receptacle 12 in the fitted state from each other, so that the sleeve 14 of the plug 11 is pulled in the −X direction and the receptacle shell 19 of the receptacle 12 is pulled in the +X direction, the sleeve contacting surface 16A of the C-ring 16 comes in contact with the sleeve corner 14B of the sleeve 14, and the receptacle shell contacting surface 16B of the C-ring 16 comes in contact with the receptacle corner 19B of the receptacle shell 19, thereby locking the fitted state between the plug 11 and the receptacle 12.

When the plug 11 and the receptacle 12 in the fitted state are going to be separated from each other, forces are exerted from the sleeve corner 14B of the sleeve 14 and the receptacle corner 19B of the receptacle shell 19 to the sleeve contacting surface 16A and the receptacle shell contacting surface 16B of the C-ring 16, respectively. At this time, since the sleeve contacting surface 16A faces in the +X and radially-outward directions, the force exerted from the sleeve corner 14B acts in the −X and radially-inward directions; and since the receptacle shell contacting surface 16B faces in the −X and radially-inward directions, the force exerted from the receptacle corner 19B acts in the +X and radially-outward directions.

Furthermore, the sleeve contacting surface 16A and the receptacle shell contacting surface 16B form inclined surfaces lying in parallel to each other and therefore, the forces exerted from the sleeve corner 14B and the receptacle corner 19B to the sleeve contacting surface 16A and the receptacle shell contacting surface 16B are directed in parallel to each other.

Figure 15:
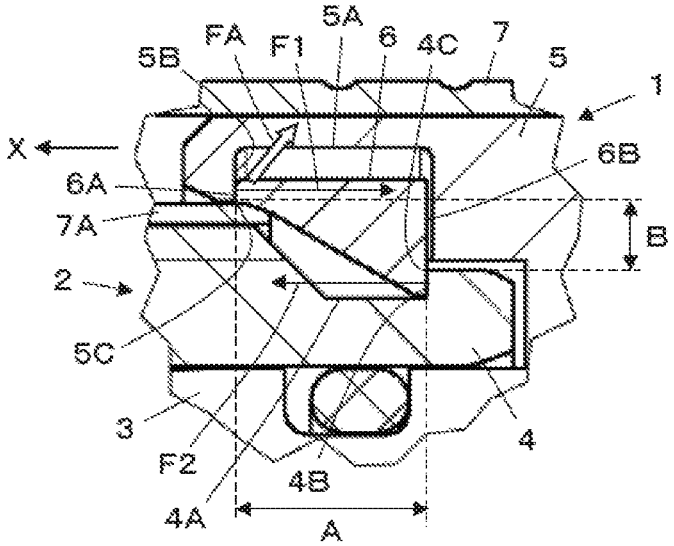
FIG. 15 PRIOR ART
FIG. 15 is a cross-sectional view partially showing a locking structure of a conventional connector assembly in a fitted state.

As a result, even if the distances in the fitting direction and in the radial direction perpendicular to the fitting direction between the sleeve corner 14B and the receptacle corner 19B in the fitted state are specified to certain values as the standards and are the same as those for the conventional connector assembly shown in FIG. 15, a couple resulting from the forces exerted from the sleeve corner 14B and the receptacle corner 19B and occurring at the C-ring 16 is to be smaller than that occurring in the conventional connector assembly. Therefore, even when a large force acts to separate the plug 11 and the receptacle 12 from each other, the C-ring 16 is prevented from plastically deforming beyond the limit of elasticity, thus reliably locking the fitted state between the plug 11 and the receptacle 12.

When, in a cross section along the X direction, the sleeve contacting surface 16A and the receptacle shell contacting surface 16B of the C-ring 16 extend in a direction perpendicular to the straight line L connecting the sleeve corner 14B of the sleeve 14 and the receptacle corner 19B of the receptacle shell 19 as shown in FIG. 11, a couple resulting from the forces exerted from the sleeve corner 14B and the receptacle corner 19B does not occur at the C-ring 16, thus more reliably locking the fitted state between the plug 11 and the receptacle 12.

Figure 12:
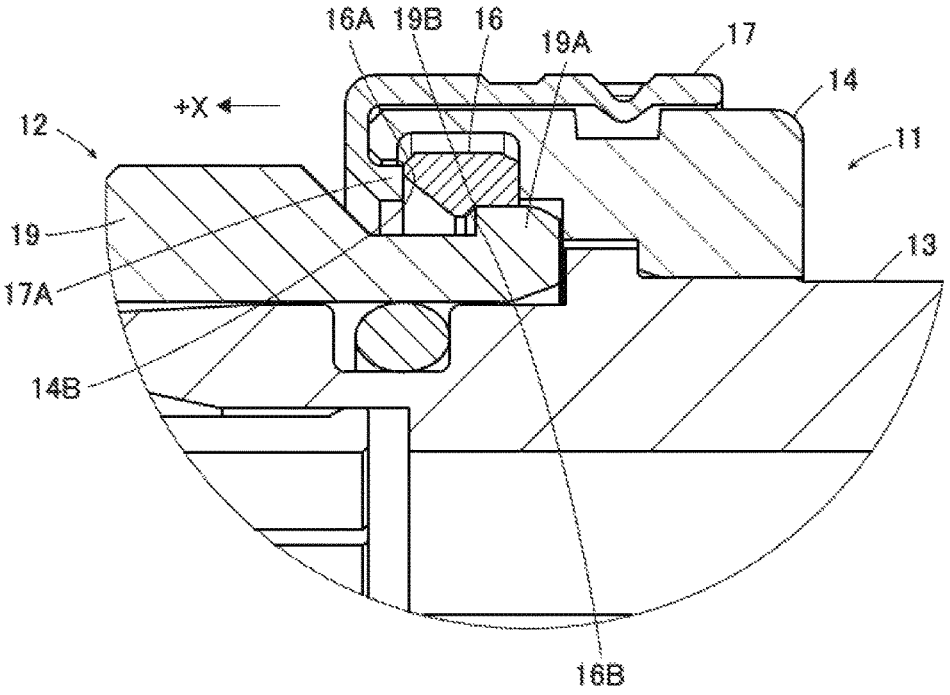
FIG. 12 is a cross-sectional view partially showing the locking structure of the connector assembly according to Embodiment 1 at the start of releasing a lock of the fitted state.

To release the lock of the fitted state between the plug 11 and the receptacle 12, as shown in FIG. 12, the coupling 17 is slid with respect to the sleeve 14 in the −X direction to bring the turning-back portion 17A of the coupling 17 into contact with the +X direction-side end of the C-ring 16 and further slid, together with the C-ring 16, in the −X direction to move the sleeve contacting surface 16A of the C-ring 16 away from the sleeve corner 14B of the sleeve 14. When, under this condition, a force acts to separate the plug 11 and the receptacle 12 from each other along the X direction, the receptacle corner 19B of the receptacle shell 19 is relatively moved in the +X direction while making contact with the receptacle shell contacting surface 16B of the C-ring 16, which causes the C-ring 16 to elastically deform so that the ring diameter gradually increases.

Figure 13:
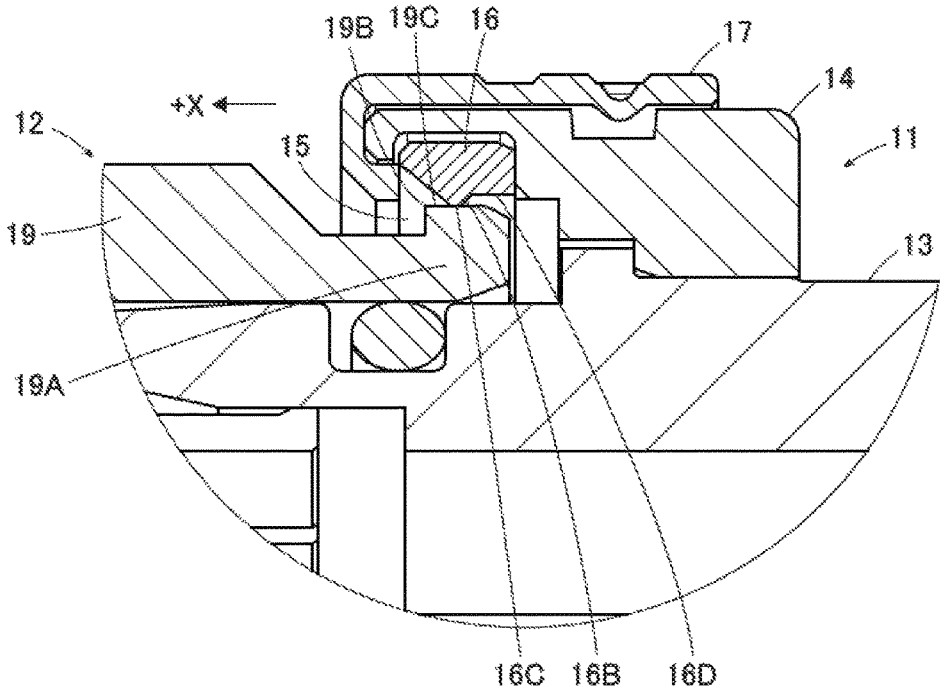
FIG. 13 is a cross-sectional view partially showing the locking structure of the connector assembly according to Embodiment 1 in a lock released state.

Thereafter, when the receptacle corner 19B of the receptacle shell 19 passes the receptacle shell contacting surface 16B of the C-ring 16, and the outer surface 19C of the end 19A of the receptacle shell 19 comes in contact with the cylindrical surface 16C of the C-ring 16, the ring diameter of the C-ring 16 becomes the maximum, and the peripheral portion of the C-ring 16 is housed in the C-ring housing groove 14A of the sleeve 14, as shown in FIG. 13.

The state of the C-ring 16 with a ring diameter being maximum as above is called "second state." As compared to the first state where the plug 11 and the receptacle 12 are fitted to each other, in the second state, the C-ring 16 is elastically deformed in the radially-outward direction by the height difference H between the cylindrical surfaces 16C and 16D of the C-ring 16 shown in FIG. 5, and the ring diameter in the second state is larger by (2×H) than that in the first state.

When the C-ring 16 is in the second state, the receptacle shell 19 does not catch on any parts. Under this condition, by pulling the receptacle shell 19 with respect to the plug shell 13 in the +X direction, the fitted state between the plug 11 and the receptacle 12 can be released.

When the receptacle shell 19 has been pulled out from the plug shell 13, the ring diameter of the C-ring 16 decreases, and the C-ring 16 returns to the position shown in FIGS. 5 and 10.

Thus, the C-ring 16 has the sleeve contacting surface 16A and the receptacle shell contacting surface 16B that form inclined surfaces lying parallel to each other and extending to diagonally intersect the fitting axis C, and the sleeve contacting surface 16A and the receptacle shell contacting surface 16B come in contact with the sleeve corner 14B of the sleeve 14 and the receptacle corner 19 of the receptacle shell 19, respectively. Owing to this configuration, even when a large external force acts to separate the plug 11 and the receptacle 12 from each other, the fitted state between the plug 11 and the receptacle 12 can stay locked.

Embodiment 2

Figure 14:
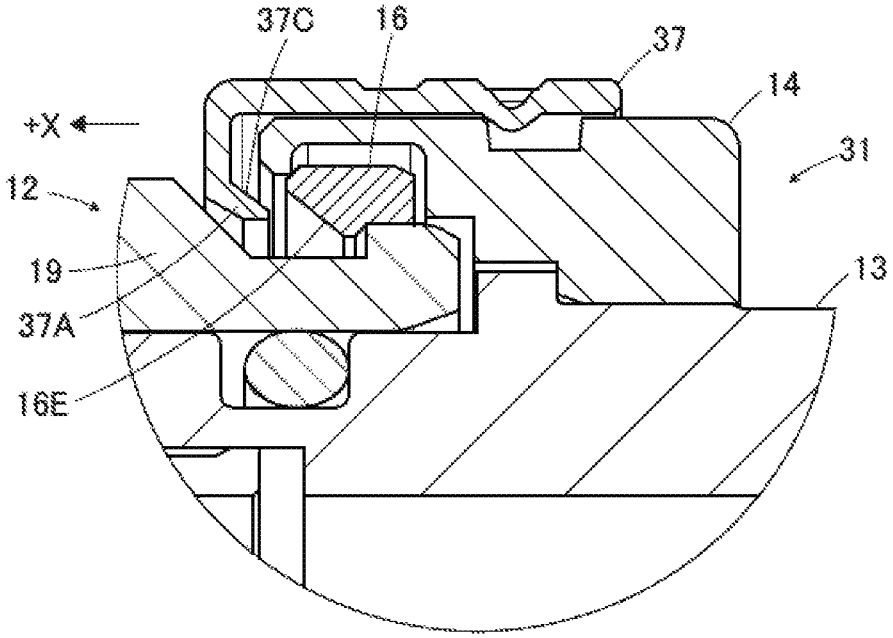
FIG. 14 is a cross-sectional view partially showing a locking structure of a connector assembly according to Embodiment 2 in a fitted state.

FIG. 14 shows a locking structure of a connector assembly according to Embodiment 2 in the fitted state. In this connector assembly, in place of the plug 11 in Embodiment 1, a plug 31 is fitted to the receptacle 12. The plug 31 is configured to have a coupling 37 in place of the coupling 17 that is used in the plug 11 in Embodiment 1, and the other constituent elements are the same as in the plug 11.

The coupling 37 has, at the +X direction-side end, a turning-back portion 37A that lies on the radially-inward side and extends in the −X direction. The turning-back portion 37A has a coupling inclined surface 37C formed to face in the −X and radially-outward directions. The coupling inclined surface 37C faces the receptacle shell inviting surface 16E of the C-ring 16 in the fitted state between the plug 31 and the receptacle 12. When the coupling 37 is slid with respect to the sleeve 14 in the −X direction, the coupling inclined surface 37C comes in contact with the receptacle shell inviting surface 16E of the C-ring 16, which causes the C-ring 16 to elastically deform so that the ring diameter increases.

Thus, the slide operation of the coupling 37 directly enables the C-ring 16 to elastically deform, and the lock of the fitted state can be released through easier manipulation.

In Embodiments 1 and 2 described above, the sleeve contacting surface 16A and the receptacle shell contacting surface 16B form inclined surfaces that lie in parallel to each other and extend in a direction perpendicular to the straight line L connecting the sleeve corner 14B of the sleeve 14 and the receptacle corner 19B of the receptacle shell 19, and this configuration allows the minimum couple of forces to occur. However, the present invention is not limited thereto, and the occurrence of a couple of forces can be reduced compared to conventional locking structures as long as a sleeve contacting surface and a receptacle shell contacting surface form inclined surfaces extending to diagonally intersect the fitting direction.

While described above are the locking structures of the connector assemblies of single contact type which are attached to the coaxial cables 21 and 22, the present invention is not limited thereto and is applicable to locking structures of various types of connector assemblies each having a plug and a receptacle that are fitted to each other along the fitting direction, such as connector assemblies of plural contact type.

What is claimed is:

1. A locking structure of a connector assembly having a plug and a receptacle that are fitted to each other along a fitting axis, wherein the plug includes a plug shell of cylindrical shape, a sleeve of cylindrical shape disposed on outer periphery of the plug shell, and a C-ring disposed between the outer periphery of the plug shell and inner periphery of the sleeve, wherein the receptacle includes a receptacle shell of cylindrical shape having an end that is inserted between the outer periphery of the plug shell and the inner periphery of the sleeve when the receptacle is fitted to the plug, wherein the C-ring has, on its outer periphery, a sleeve contacting surface facing in a first direction and a radially-outward direction and, on its inner periphery, a receptacle shell contacting surface facing in a second direction and a radially-inward direction, the first direction being a direction from the plug to the receptacle along the fitting axis, and the second direction being a direction opposite from the first direction along the fitting axis, and the C-ring is elastically deformable between a first state in which the C-ring has a ring diameter allowing the receptacle shell contacting surface to come in contact with the receptacle shell and a second state in which the C-ring has a ring diameter, larger than that in the first state, allowing the receptacle shell contacting surface to separate from the receptacle shell, wherein the sleeve contacting surface and the receptacle shell contacting surface each form an inclined surface extending to diagonally intersect the fitting axis, and wherein when, with the C-ring being in the first state, the sleeve contacting surface comes in contact with the sleeve and the receptacle shell contacting surface comes in contact with the receptacle shell, a fitted state between the plug and the receptacle is locked.

2. The locking structure of a connector assembly according to claim 1, wherein the sleeve has a sleeve corner facing in the second direction and the radially-inward direction, wherein the end of the receptacle shell has a receptacle corner facing in the first direction and the radially-outward direction, and wherein when, with the C-ring being in the first state, the sleeve contacting surface comes in contact with the sleeve corner and the receptacle shell contacting surface comes in contact with the receptacle corner, the fitted state between the plug and the receptacle is locked.

3. The locking structure of a connector assembly according to claim 2, wherein when the plug and the receptacle are in the fitted state, in a cross section along the fitting axis, the sleeve contacting surface and the receptacle shell contacting surface of the C-ring extend in parallel to each other in a direction perpendicular to a straight line connecting the sleeve corner and the receptacle corner.

4. The locking structure of a connector assembly according to claim 1, wherein the plug includes a coupling of cylindrical shape that is disposed on outer periphery of the sleeve to be capable of sliding with respect to the sleeve in the first and second directions and making contact with the C-ring, and wherein, in the fitted state between the plug and the receptacle, when the coupling is slid in the second direction to elastically deform the C-ring from the first state to the second state, a lock of the fitted state between the plug and the receptacle is released.

5. The locking structure of a connector assembly according to claim 4, wherein the coupling has, at its end on a side facing in the first direction, a turning-back portion that lies on the radially-inward side and extends in the second direction, and wherein when the coupling is slid in the second direction, the turning-back portion comes in contact with an end of the C-ring facing in the first direction.

6. The locking structure of a connector assembly according to claim 5, wherein when the coupling is slid in the second direction, the turning-back portion comes in contact with the end of the C-ring facing in the first direction and moves the C-ring in the second direction with the receptacle shell contacting surface, which forms the inclined surface, being kept in contact with the receptacle shell, to elastically deform the C-ring from the first state to the second state.

7. The locking structure of a connector assembly according to claim 5, wherein the turning-back portion has a coupling inclined surface facing in the second direction and the radially-outward direction, and wherein when the coupling is slid in the second direction, the coupling inclined surface comes in contact with the C-ring to elastically deform the C-ring from the first state to the second state.

8. The locking structure of a connector assembly according to claim 1, wherein the C-ring has a receptacle shell inviting surface facing in the first direction and the radially-inward direction.

* * * * *